US011701794B1

(12) United States Patent
Reznicek et al.

(10) Patent No.: US 11,701,794 B1
(45) Date of Patent: Jul. 18, 2023

(54) METHOD OF FORMING A SPORTS BAT AND SPORTS BAT ARTICLE

(71) Applicant: REZBATS, LLC, Sioux Falls, SD (US)

(72) Inventors: Benjamin Reznicek, Sioux Falls, SD (US); David Reznicek, Sioux Falls, SD (US)

(73) Assignee: RezBats, LLC, Sioux Falls, SD (US)

( * ) Notice: Subject to any disclaimer, the term of this patent is extended or adjusted under 35 U.S.C. 154(b) by 251 days.

(21) Appl. No.: 16/887,363

(22) Filed: May 29, 2020

Related U.S. Application Data

(60) Provisional application No. 62/855,034, filed on May 31, 2019.

(51) Int. Cl.

| | |
|---|---|
| ***A63B 59/52*** | (2015.01) |
| ***B27M 3/22*** | (2006.01) |
| ***B27K 5/06*** | (2006.01) |
| *A63B 102/18* | (2015.01) |

(52) U.S. Cl.
CPC ..... *B27M 3/22* (2013.01); *A63B 59/52* (2015.10); *B27K 5/065* (2013.01); *A63B 2102/18* (2015.10); *A63B 2209/00* (2013.01)

(58) Field of Classification Search
CPC . B27M 3/22; B27K 5/00; B27K 5/065; A63B 59/50; A63B 59/52; A63B 2102/18; A63B 2209/00
See application file for complete search history.

(56) References Cited

U.S. PATENT DOCUMENTS

| | | | | | |
|---|---|---|---|---|---|
| 2,039,221 | A * | 4/1936 | Hillerich | B27K 3/083 | 427/393 |
| 2,804,399 | A * | 8/1957 | Kelly | A63B 59/50 | 427/408 |
| 3,129,003 | A * | 4/1964 | Mueller | A63B 60/14 | 273/DIG. 7 |
| 3,220,731 | A * | 11/1965 | Germino | A63D 9/00 | 427/415 |
| 5,800,293 | A * | 9/1998 | MacKay, Jr. | B27M 3/22 | 473/464 |
| 6,139,451 | A * | 10/2000 | Hillerich, III | A63B 59/52 | 473/567 |
| 6,238,309 | B1 * | 5/2001 | Sample | A63B 59/52 | 473/567 |

(Continued)

FOREIGN PATENT DOCUMENTS

| | | | | |
|---|---|---|---|---|
| KR | 1867188 | * | 6/2018 | A63B 59/52 |

OTHER PUBLICATIONS

Minwax Company, Safety Data Sheet 41700, Minwax High Performance Wood Hardener, 13 pages, issue date Oct. 17, 2018.

*Primary Examiner* — Raleigh W Chiu
(74) *Attorney, Agent, or Firm* — Jeffrey A. Proehl; Woods, Fuller, Shultz & Smith, PC

(57) ABSTRACT

A sports bat article, and a method of forming the sport bat, is disclosed. The method may include shaping an elongate wood piece to have a barrel portion and a handle portion suitable to be used as a sport bat, with the wood piece having a shaped surface. The method may also include applying a substance to the shaped surface of the wood piece in which the substance may be effective to harden a surface of the wood piece. Applying the substance to the shaped surface of the wood piece may include immersing a portion of the wood piece into a pool of the substance.

13 Claims, 3 Drawing Sheets

(56) References Cited

U.S. PATENT DOCUMENTS

| | | | | |
|---|---|---|---|---|
| 6,287,221 | B1 * | 9/2001 | Pino | A63B 59/52 156/309.6 |
| 6,471,608 | B1 * | 10/2002 | Mitchell | A63B 59/52 427/441 |
| 7,841,372 | B2 * | 11/2010 | Gill | B27M 1/02 144/2.1 |
| 2005/0020391 | A1 * | 1/2005 | Bao | B27M 3/0053 473/564 |
| 2007/0202968 | A1 * | 8/2007 | Zappel | A63B 69/0002 473/424 |
| 2008/0308184 | A1 * | 12/2008 | Gill | B27M 3/22 100/171 |
| 2008/0308187 | A1 * | 12/2008 | Dill | B27M 3/22 144/350 |
| 2011/0015008 | A1 * | 1/2011 | MacDougall | A63B 59/52 473/564 |
| 2015/0144226 | A1 * | 5/2015 | Suthar | B27K 1/00 144/356 |
| 2017/0182512 | A1 * | 6/2017 | Swift | B05D 5/00 |
| 2018/0333836 | A1 * | 11/2018 | Huner | B25G 1/01 |
| 2020/0346086 | A1 * | 11/2020 | Benda | A63B 59/52 |

* cited by examiner

METHOD OF FORMING A SPORTS BAT AND SPORTS BAT ARTICLE

REFERENCE TO RELATED APPLICATIONS

This application claims the benefit of U.S. Provisional Patent Application No. 62/855,034, filed May 31, 2019, which is hereby incorporated by reference in its entirety.

BACKGROUND

Field

The present disclosure relates to sports bats and more particularly pertains to a new method of forming a sports bat, and a sports bat article, for providing a sports bat with enhanced durability.

SUMMARY

In one aspect, the present disclosure relates to a method of forming a sport bat, and the method may comprise shaping an elongate wood piece to have a barrel portion and a handle portion suitable to be used as a sport bat, so that the wood piece has a shaped surface. The method may also comprise applying a substance to the shaped surface of the wood piece, and the substance may be effective to harden a surface of the wood piece. Applying the substance to the shaped surface of the wood piece may include immersing a portion of the wood piece into a pool of the substance.

In another aspect, the disclosure relates to a sports bat formed using aspects of the disclosed method.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components, and the particulars of the steps, set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
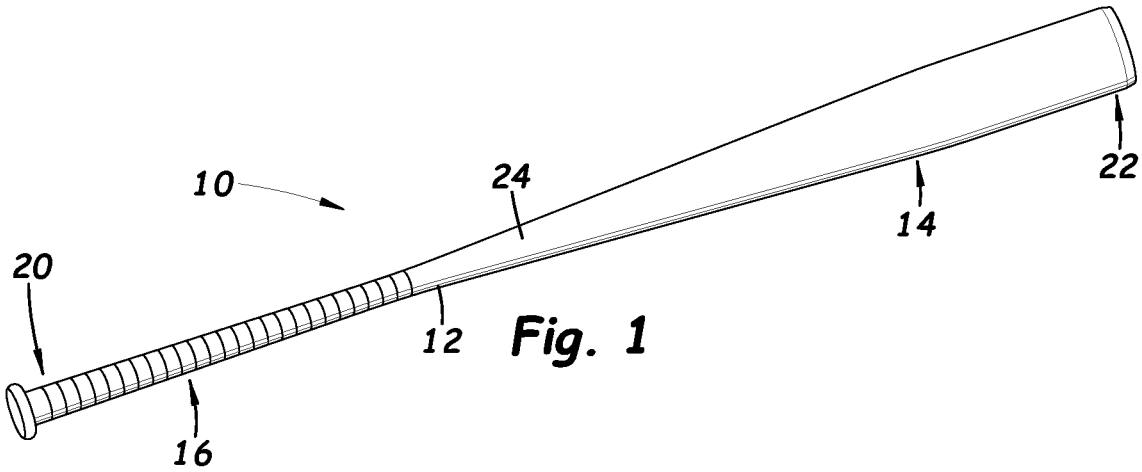
FIG. 1 is a schematic perspective view of the sports bat article, according to the present disclosure.
Figure 2:
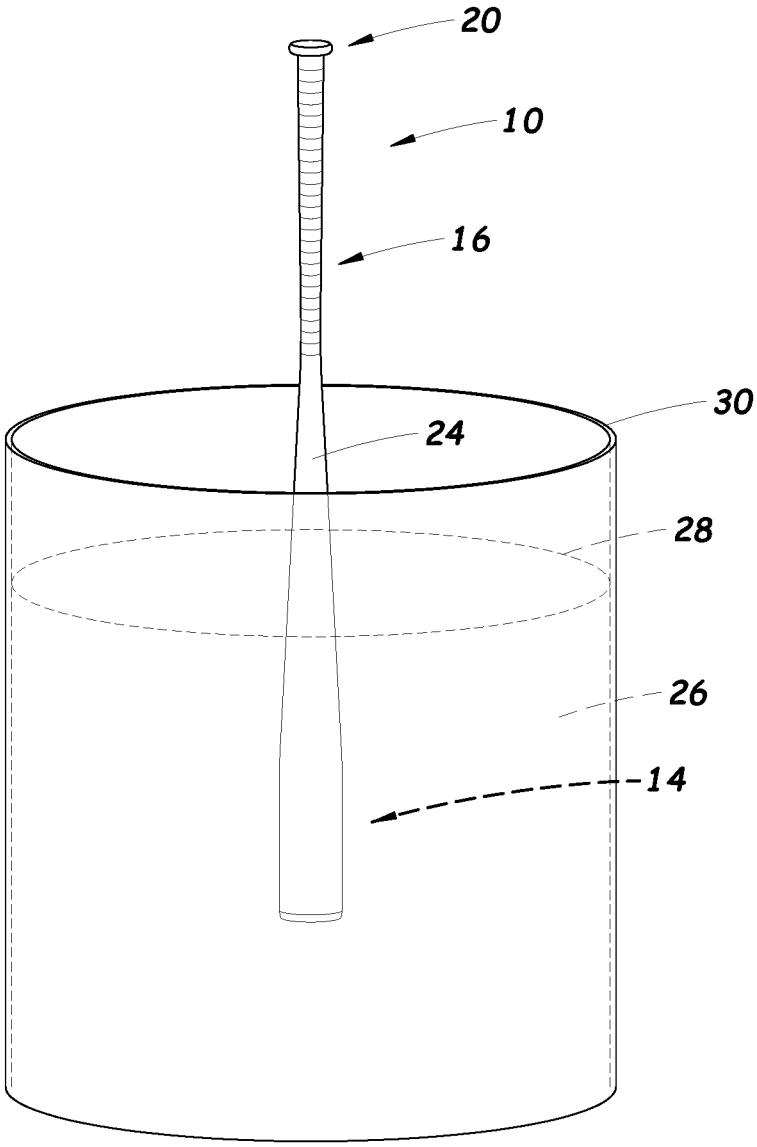
FIG. 2 is a schematic perspective view of the sports bat during a partial immersion step of the method, according to an illustrative implementation of the method.
Figure 3:
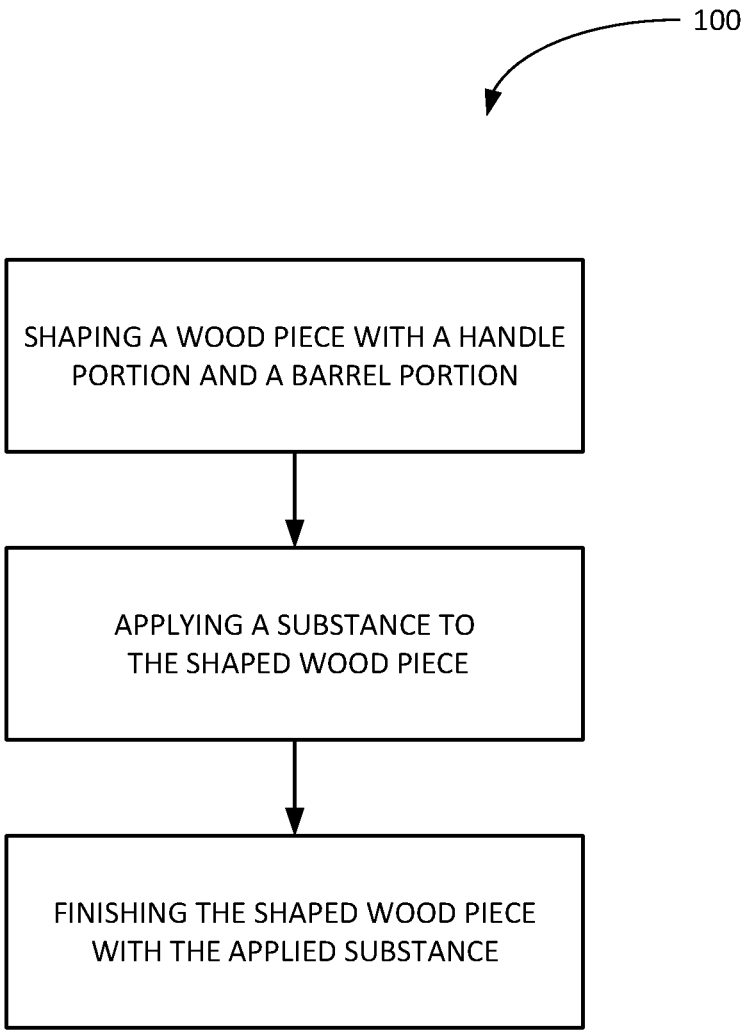
FIG. 3 is a schematic flow diagram of a new method of forming a sports bat according to the present disclosure.
Figure 4:
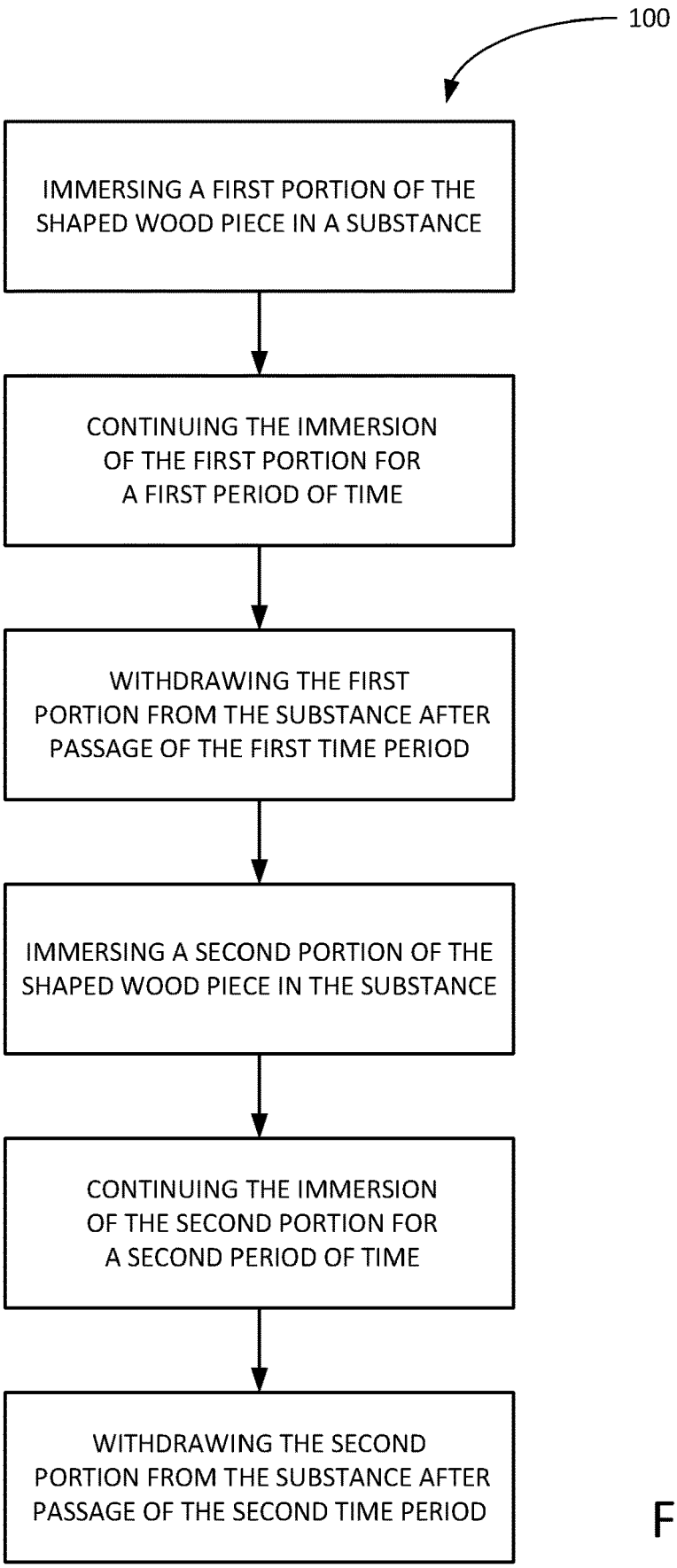
FIG. 4 is a schematic flow diagram of aspects of the method of forming a sports bat, according to an illustrative implementation.

With reference now to the drawings, and in particular to FIGS. 1 through 4 thereof, a new method of forming a sports bat, and a sports bat article, embodying the principles and concepts of the disclosed subject matter will be described.

The applicants have recognized that enhancing the strength and durability of sports bats, such as baseball bats, is desirable to enhance the longevity or useful life of the bats and also enhance the safety of the use of the bat by decreasing the likelihood of the bat breaking, particularly into multiple pieces, and allowing a piece or pieces of the broken bat to fly uncontrollably through the air of the ball field. While selection of the material used to form the bat, such as various species of wood, may have some effect on the durability of the bat, even the strongest wood species are vulnerable to breakage during use in a baseball game.

The applicants thus sought other ways of enhancing the strength and durability of the sports bat, and determined that increasing the hardness of the surface of the bat (and optionally interior portions of the bat below the surface) can greatly enhance the resistance of the bat to breakage of the wood material resulting in significant cracking and even partial or complete separation of portions of the bat into multiple pieces during use (while generally limiting any breakage to cracking which leaves the bat intact). Yet a further benefit may be a stabilization of the moisture content of the bat through blocking or closing off of the pores of the material forming the bat from absorbing moisture which can minimize any variation in the weight of the bat due to moisture absorption, particularly in humid environments. Further, small imperfections or voids below the surface of the bat may be filled to minimize the compromise in strength and durability caused by the imperfections and voids. Such benefits may be achieved by treating the material forming the bat in a manner that tends to bind together the fibers of the grain of the bat material. The applicants have recognized that this may be accomplished by penetrating relatively porous outer surface portions of the wood material used to form the bat with a substance that may have the ability to bind and strengthen the wood material to minimize any inherent defects or weaknesses in the wood material utilized for the sports bat.

In one aspect, the disclosure relates to a method 100 of forming a sports bat 10 typically utilized to strike a ball or other object, and illustratively comprises a baseball bat which is swung to strike a baseball utilized in the game of baseball. However, aspects of the disclosure may be utilized with bats used in other sports and could be applied to elongate objects used in other disciplines.

The method may include shaping an elongate piece 12 of material, such as a wood material or a wood composite material, to have a barrel portion 14 and a handle portion 16. The handle portion 16 may be located toward a proximate end 20 of the wood piece 12 and the barrel portion 14 may be located toward a distal end 22 of the wood piece 12. The barrel portion 14 and the handle portion 16 may each have a respective diameter, and the barrel portion generally having a relatively larger diameter and the handle portion having a relatively smaller diameter, with the diameter of the piece 12 tapering smaller from the barrel portion toward the handle portion. Illustratively, the wood piece may be formed of a wood type selected from the wood types including ash, maple, bamboo, and birch, although optionally other wood types may also be employed for the sports bat.

Shaping the elongate wood piece 12 may include providing an elongate wood blank which may have a generally cylindrical or cuboid shape, and removing wood material from the wood blank to form the barrel portion 14 and the handle portion 16 to produce a shaped surface 24 on the wood piece generally corresponding to the desired final shape and contour of the bat 10. Typically, although not necessarily, and such removal of material is performed using a leaf apparatus.

The method may also include a step of applying a substance 26 to the shaped surface 24 of the wood piece 12, and typically the substance is applied to the shaped surface to enhance the hardness of the surface 24 or portions of the wood piece 12 adjacent to the surface to enhance the durability of the sports bat 10 during use. The substance may be effective to, or have the effect of, hardening the shaped surface of the wood piece after application to the surface 24. Typically, the substance has a flowable or liquid condition prior to and during application to the wood piece 12, which may enhance the ability of the substance to penetrate or otherwise enter portions of the wood piece 12 adjacent to the shaped surface 24. The substance may also assume a non-flowable or hardened condition as a result of prolonged exposure to environmental air or simply the passage of time after application to the piece 12.

Suitable substances may include various resins and polymeric materials which are capable of penetrating the surface of wood into the pores of the wood either alone or in combination with suitable solvents. One class of suitable substances are commonly referred to as "wood hardeners" which are utilized to repair or stabilize rotted or decayed wood fibers and seal the wood against further moisture penetration into the wood leading to further decay, often prior to the addition of a wood filler to restore areas of wood that has rotted away and been removed. An illustrative component of a suitable substance may include polyurethane. One highly suitable example of the substance is available under the tradename "MINWAX Wood Hardener" from the Minwax Company, 101 Prospect Ave, Cleveland, Ohio 44115. Other substances may also be suitable for the purposes and functions of the substance.

The step of applying the substance 26 to the wood piece 12 may include immersing at least a section of the wood piece into the substance, and may include immersing all of the wood piece or only a part or portion of the wood piece. All, or a portion, of the wood piece may be immersed in a quantity or a pool 28 of the substance of sufficient depth to permit a sufficient section of the wood piece 12 to be immersed in the substance. For example, immersion may occur in an excess quantity of the substance contained in a container 30 with an open top. In some implementations, the immersion may be accomplished by dipping a section, such as one of the portions 14, 16, into the substance and may include leaving another one of the portions 14, 16 out of the substance. Immersing a portion of the wood piece may include maintaining the immersed portion in the immersed condition for a predetermined time period. Such time period may be selected to permit the substance to penetrate the wood beyond only coating the surface of the wood piece.

In some implementations of the method 100, applying the substance to the shaped surface 24 of the wood piece 12 may include first dipping one portion of the wood piece in the substance for a period of time, removing the one portion of the wood piece from the substance, and then dipping another portion of the wood piece in the substance for a period of time. Typically, such a technique may be utilized in situations where the time period of immersion varies between different sections or portions of the wood piece 12. Illustratively, this aspect of the method may be implemented by dipping the barrel portion of the wood piece into the substance, withdrawing the barrel portion from the substance, dipping the handle portion of the wood piece into the substance, and withdrawing the handle portion from the substance. Optionally, the order of dipping the respective portions may be reversed.

The application of the substance to the shaped surface 24 may be continuous for the entire period of time. In some implementations, the period of time for which distinct portions of the wood piece are immersed in the substance may be different from each other to achieve different characteristics for different portions of the wood piece, such as a variation in the enhancement of the hardness of the wooden material between portions. The degree to which the time periods of immersion vary among portions of the peace 12 may generally correspond to the degree of variation desired in the characteristic enhanced by the substance. For example, portions of the piece 12 which are desired to have greater hardness or durability may have relatively longer immersion time periods than immersion time periods for the portions of the piece 12 which require less hardness or durability.

In implementations of the method, the period may be selected based upon the degree to which the substance is able to pass through the shaped surface 24 and penetrate portions of the wood piece 12 located below the shaped surface to a depth suitable to, for example, enhance the hardness of the shaped surface and increase the resistance of the wood piece to absorption of moisture through the shaped surface.

As an example, in some implementations of the method, the time period over which the barrel portion 14 is immersed in the substance 26 may be longer than the time period over which the handle portion 16 is immersed. Illustratively, the period of time for immersion of the handle portion of the wood piece 12 in the substance may be in the range of zero seconds to approximately 20 seconds, and may be at least approximately 10 seconds, while in still further implementations the time period may range from approximately 10 seconds to approximately 20 seconds. The period of time for immersion of the barrel portion of the wood piece in the substance may be in the range of zero seconds to approximately 60 seconds, and may be at least approximately 15 seconds, while still further implementations of time period may range from approximately 15 seconds to approximately 60 seconds. Such time periods have been found to be highly suitable for achieving the desired relative hardness and strength enhancement of the wood piece, although other time periods may be utilized.

The method may also include the step of finishing the shaped wood piece having the applied substance 26 thereon, and may include, for example, drying the applied substance 26 on the shaped wood piece through, for example, exposure to air for a suitable period of time.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

Further, those skilled in the art will appreciate that steps set forth in the description and/or shown in the drawing figures may be altered in a variety of ways. For example, the order of the steps may be rearranged, substeps may be performed in parallel, shown steps may be omitted, or other steps may be included, etc.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

We claim:

1. A method of forming a sport bat, the method comprising:

shaping an elongate wood piece to have a shaped surface forming a barrel portion and a handle portion, the wood piece with the shaped surface being suitable to be used as a sport bat; and after the step of shaping the elongate wood piece to have the shaped surface, applying a wood hardener substance to the shaped surface of the wood piece, the substance being effective to harden the shaped surface of the wood piece and interior portions of the wood piece below the shaped surface, the applying of the wood hardener substance to the shaped surface of the wood piece including:

immersing a portion of the wood piece into a pool of the wood hardener substance; and permitting the wood hardener substance applied to the shaped surface of the wood piece to penetrate the wood piece below the shaped surface.

2. The method of claim 1 wherein immersing the portion of the wood piece includes dipping the portion of the wood piece into an excess quantity of the wood hardener substance contained in a container.

3. The method of claim 1 wherein applying the substance to the shaped surface includes first dipping one portion of the wood piece in the wood hardener substance and second dipping another portion of the wood piece in the wood hardener substance.

4. The method of claim 3 additionally including withdrawing the one portion of the wood piece from the pool of the wood hardener substance prior to the step of second dipping the another portion.

5. The method of claim 1 wherein applying the wood hardener substance to the shaped surface includes first dipping the handle portion of the wood piece in the wood hardener substance and second dipping the barrel portion of the wood piece in the wood hardener substance.

6. The method of claim 1 wherein the step of applying the wood hardener substance to the shaped surface of the wood piece is continued for a period of time.

7. The method of claim 6 wherein the step of applying the wood hardener substance to the shaped surface of the wood piece is continued for the entire period of time.

8. The method of claim 6 wherein the period of time of application of the wood hardener substance is different for different portions of the wood piece.

9. The method of claim 8 wherein the period of time for the handle portion of the wood piece ranges up to approximately 20 seconds.

10. The method of claim 8 wherein the period of time for the barrel portion of the wood piece ranges up to approximately 60 seconds.

11. The method of claim 1 additionally comprising finishing the shaped wood piece with the applied wood hardener substance.

12. The method of claim 11 wherein the step of finishing the shaped wood product includes drying the applied wood hardener substance on the shaped wood piece.

13. The method of claim 1 wherein shaping the wood piece includes providing an elongate wood blank and removing wood material from the wood blank to form the barrel portion and the handle portion to produce the shaped surface on the wood piece.

* * * * *